US010573982B2

(12) United States Patent
Takamori

(10) Patent No.: US 10,573,982 B2
(45) Date of Patent: Feb. 25, 2020

(54) TERMINAL REMOVABLE DEVICE

(71) Applicant: OMRON Corporation, Kyoto (JP)

(72) Inventor: Satoshi Takamori, Kanagawa (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 16/165,369

(22) Filed: Oct. 19, 2018

(65) Prior Publication Data

US 2019/0148849 A1 May 16, 2019

(30) Foreign Application Priority Data

Nov. 13, 2017 (JP) ..... 2017-218336

(51) Int. Cl.

| | |
|---|---|
| ***H01R 9/24*** | (2006.01) |
| ***H01R 13/627*** | (2006.01) |
| ***H01R 13/20*** | (2006.01) |
| ***H01R 11/12*** | (2006.01) |

(52) U.S. Cl.

CPC ..... *H01R 9/2416* (2013.01); *H01R 13/20* (2013.01); *H01R 13/6278* (2013.01); *H01R 11/12* (2013.01)

(58) Field of Classification Search

CPC ..... H01R 13/6272; H01R 13/6275; H01R 13/6278; H01R 13/20; H01R 9/2416; H01R 11/12

USPC ..... 439/352

See application file for complete search history.

(56) References Cited

U.S. PATENT DOCUMENTS

| | | | | |
|---|---|---|---|---|
| 10,128,612 | B1 * | 11/2018 | Casto | H01R 13/6275 |
| 2007/0149028 | A1 * | 6/2007 | Yu | G02B 6/4292 439/352 |
| 2012/0028483 | A1 | 2/2012 | Gassaur et al. | |
| 2015/0093943 | A1 | 4/2015 | Nagasaki et al. | |
| 2017/0187129 | A1 | 6/2017 | Yamada | |
| 2018/0309215 | A1 * | 10/2018 | Harmon, III | H01R 12/721 |

FOREIGN PATENT DOCUMENTS

| | | |
|---|---|---|
| CN | 102332641 A | 1/2012 |
| CN | 104518296 A | 4/2015 |
| CN | 107069255 A | 8/2017 |
| JP | H09-161868 A | 6/1997 |

OTHER PUBLICATIONS

Office Action issued in Chinese Application No. 201811167752.1, dated Jan. 2, 2020 (14 pages).

* cited by examiner

*Primary Examiner* — Gary F Paumen
(74) *Attorney, Agent, or Firm* — Osha Liang LLP

(57) ABSTRACT

A terminal removable device includes a casing having an insertion port structured such that a terminal can be inserted therein, and a movable member including a latching portion configured to latch the terminal by moving from a first position to a second position with respect to the terminal inserted into the casing. The movable member includes a protrusion protruding from the casing when the movable member is at the second position. When the protrusion is pushed down to the casing side, the movable member moves from the second position to the first position to release the latching of the terminal.

15 Claims, 17 Drawing Sheets

TERMINAL REMOVABLE DEVICE

CROSS-REFERENCE TO RELATED APPLICATION

This application is based on Japanese Patent Application No. 2017-218336 filed with the Japan Patent Office on Nov. 13, 2017, the entire contents of which are incorporated herein by reference.

FIELD

The present invention relates to a terminal removable device capable of mounting and removing a terminal.

BACKGROUND

In electric facilities such as a switchboard, a machine tool, and photovoltaics (PV) equipment, a terminal block is used to connect terminals provided at the ends of various wires such as a power line and a signal line. As a basic technique for connecting a terminal to a terminal block, a common structure is to screw the terminal onto the terminal block for fixing and unscrew the terminal for removal.

In order to improve the operability related to screwing and unscrewing, for example, a terminal block disclosed in Japanese Patent Application No. H9-161868 is provided with a rod having a projection provided with a tapered surface which can be inserted into a hole formed in a terminal. In the terminal block disclosed in Japanese Patent Application No. H9-161868, the projection is inserted into the hole formed in the terminal and brought into a locked state. Then, a user can remove the terminal by lifting a knob portion of the rod.

In Japanese Patent Application No. H9-161868, it is possible to attach and remove the terminal without using screws.

However, the inventor of the present application found that there is room for improvement in operation of lifting the knob portion.

SUMMARY

The present invention has been made in view of such circumstances, and it is an object of the present invention to provide a terminal removable device with higher operability.

In order to solve the above problem, a terminal removable device includes: a casing having an insertion port into which a terminal can be inserted; and a movable member including a latching portion configured to latch the terminal by moving from a first position to a second position with respect to the terminal inserted into the casing. The movable member includes a protrusion protruding from the casing when the movable member is at the second position, and when the protrusion is pushed down to the casing side, the movable member moves from the second position to the first position to release the latching of the terminal.

Further, in the terminal removable device according to the present application, the movable member has an abutment surface on which the terminal inserted into the casing abuts, and the movable member is movable from the second position to the first position when the terminal is inserted in a state of abutting on the abutment surface, and the movable member is movable from the first position to the second position when the terminal is inserted to a position at which the terminal can be latched.

In the terminal removable device according to the present application, a direction in which the terminal is inserted is orthogonal to a direction in which the movable member moves, and the abutment surface is inclined with respect to the direction in which the terminal is inserted.

Further, in the terminal removable device according to the present application, the movable member includes a display configured to visibly display that the movable member is positioned at the second position, and the display is exposed from the casing more greatly when the movable member is positioned at the second position than when the movable member is positioned at the first position.

Further, in the terminal removable device according to the present application, the casing includes a viewing assist portion (reflecting portion) configured to indirectly make the exposed display visible when the display of the movable member is exposed.

Further, in the terminal removable device according to the present application, the number of insertion ports is two or larger, the terminal removable device includes a connection member configured to electrically connect a plurality of the terminals inserted from the different insertion ports and respectively latched by latching portions of the movable member, and the connection member includes curved portions formed so as to linearly connect the inserted terminals and avoid contact with the movable member.

Further, in the terminal removable device according to the present application, the curved portions of the connection member are formed at positions not facing each other on both sides.

Further, in the terminal removable device according to the present application, the casing has a first surface and a second surface facing each other, the insertion port is formed on each of the first surface and the second surface, a protrusion of a first movable member which latches the terminal inserted from the insertion port on the first surface side is disposed on the second surface side with a latching member, a protrusion of a second movable member that latches the terminal inserted from the insertion port on the second surface side is disposed on the first surface side with a latching member, and the first movable member and the second movable member are arranged such that a straight line connecting the protrusion of the first movable member and the protrusion of the second movable member is oblique to a straight line connecting the insertion port on the first surface side and the insertion port on the second surface side.

In the terminal removable device according to the present application, the latching of the terminal is released by pushing down the protrusion of the movable member.

The terminal removable device according to the present invention exerts excellent effects such as being capable of mounting and removing a terminal by simple operation.

DETAILED DESCRIPTION

Hereinafter, embodiments of the present invention will be described with reference to the drawings.

<Application Example>

A terminal removable device according to the present invention can be applied to various applications like a terminal block for connecting terminals provided at the ends of various wires such as a power line and a signal line in electric facilities such as a switchboard, a machine tool, and PV equipment.

First Embodiment

<Structure Example>

Figure 1:
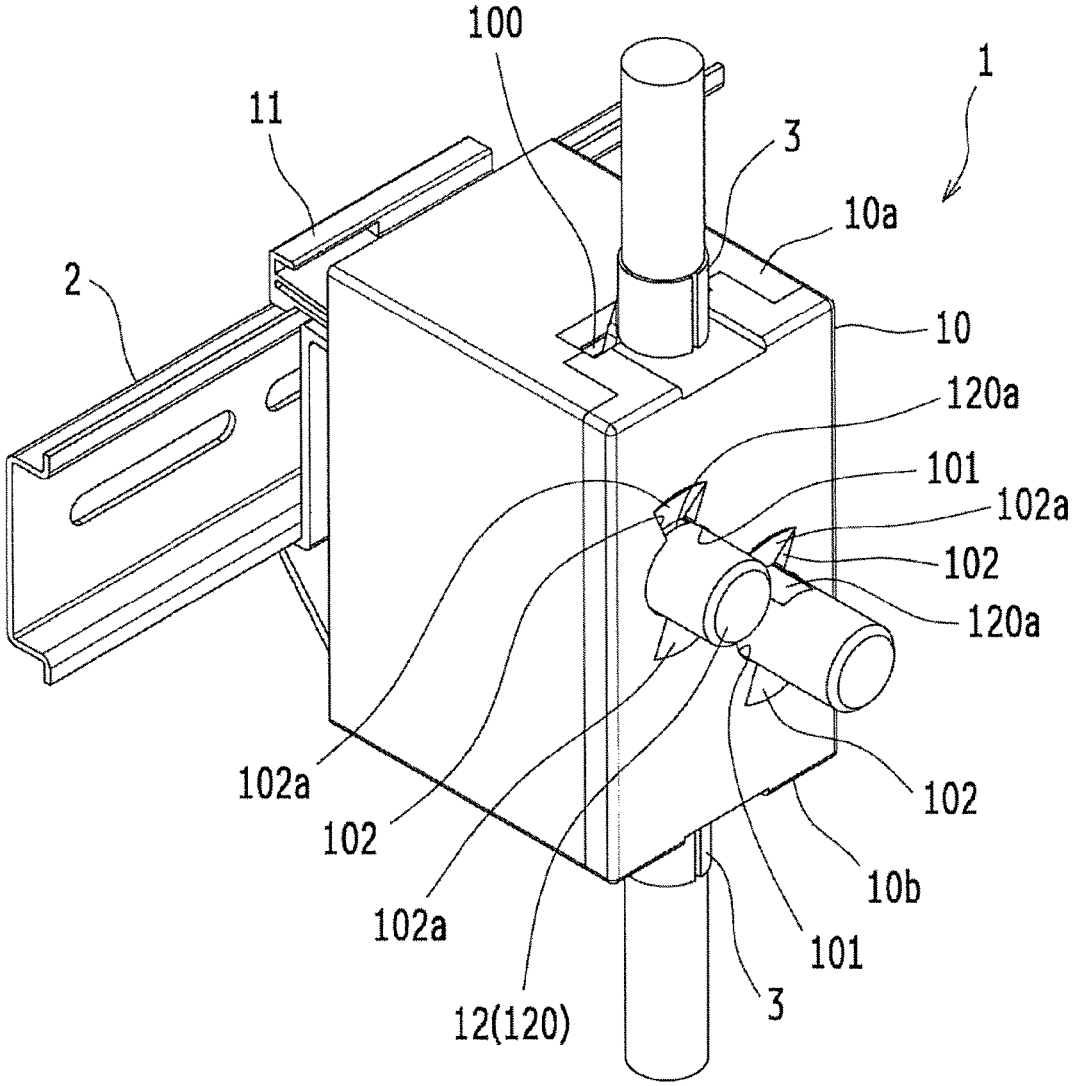
FIG. 1 is a schematic perspective view illustrating an example of an appearance of a terminal removable device according to the present application.
Figure 2:
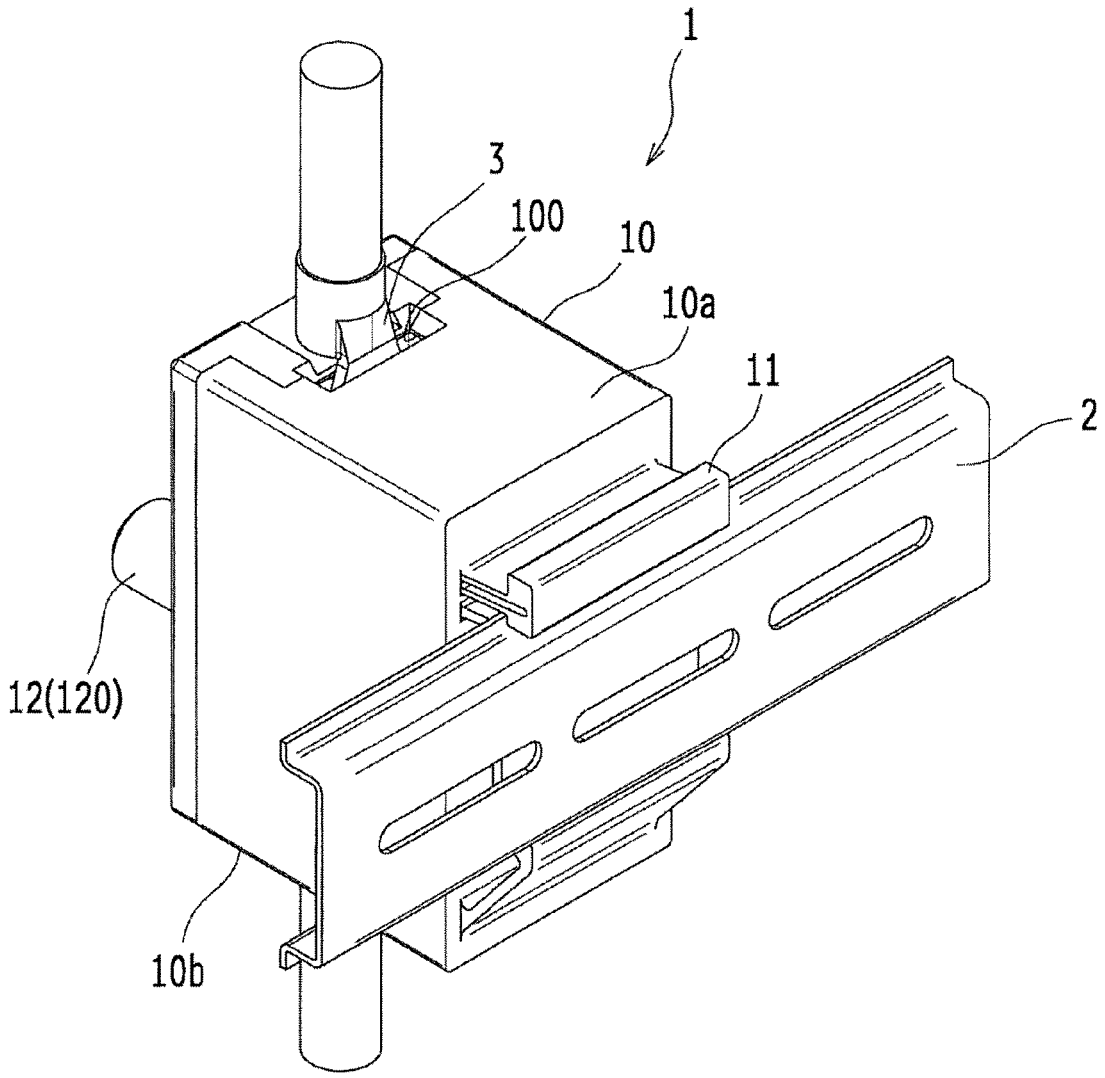
FIG. 2 is a schematic perspective view illustrating an example of the appearance of the terminal removable device according to the present application.
Figure 3A:
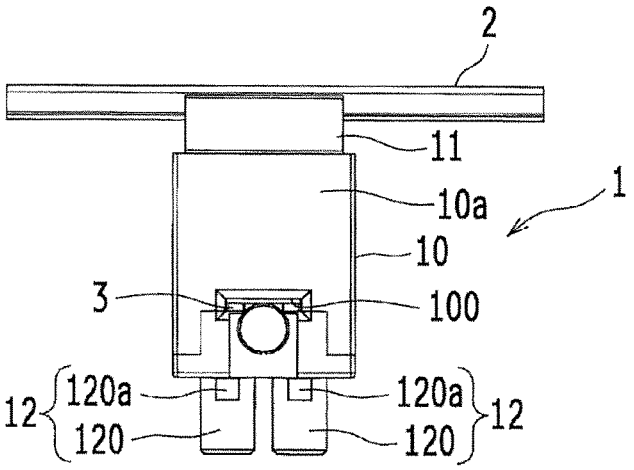
FIGS. 3A to 3C are schematic external views each showing an example of the appearance of the terminal removable device according to the present application.
Figure 3B:
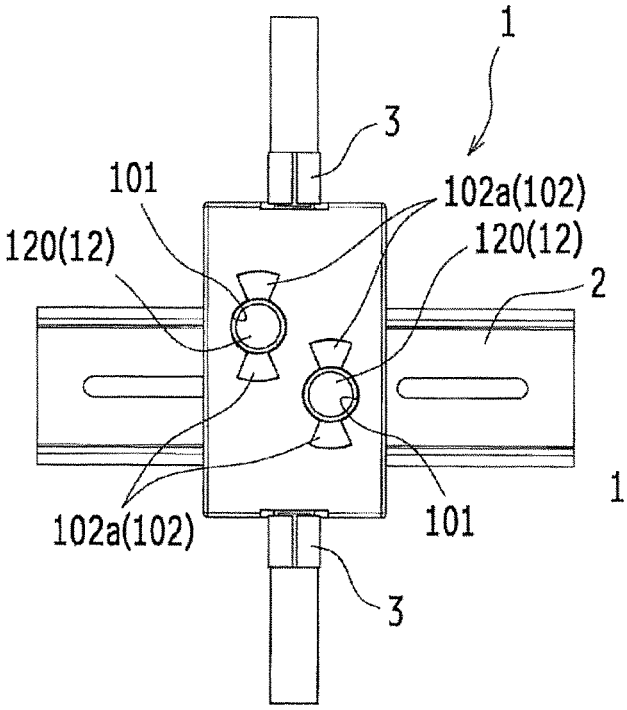
Figure 3C:
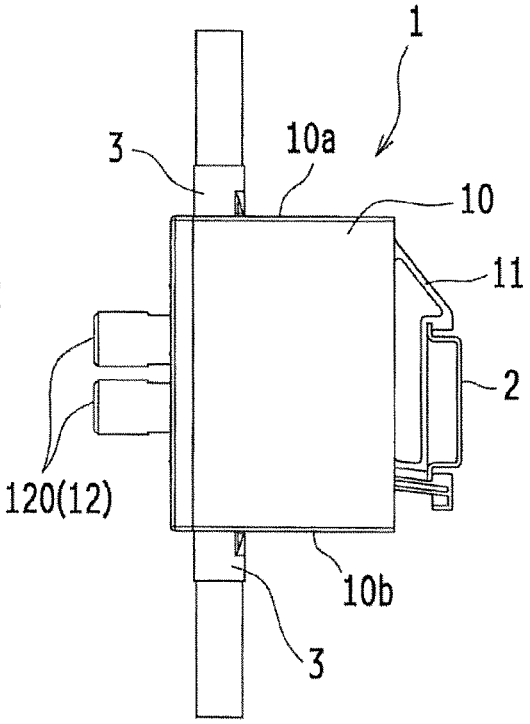

FIGS. 1 and 2 are schematic perspective views showing an example of an appearance of a terminal removable device 1 according to the present application. FIG. 1 illustrates the appearance of the terminal removable device 1 as seen from diagonally forward above, and FIG. 2 illustrates the appearance of the terminal removable device 1 as seen from diagonally rearward below. FIGS. 3A to 3C are schematic external views each showing an example of the appearance of the terminal removable device 1 according to the present application. FIGS. 3A, 3B, and 3C are a top view, a front view, and a right side view, respectively. In the following description, concerning directions in the terminal removable device 1, the front side, the back side, the upper side, and the lower side in FIG. 3B are respectively referred to as front, rear, upper, and lower. However, these are directions for convenience of description and do not limit the attachment direction of the terminal removable device 1. The terminal removable device 1 according to the present application includes a casing 10 having a substantially rectangular shape, and an attachment 11 is provided on the rear surface of the casing 10. FIGS. 1 to 3 illustrate a mode in which, the terminal removable device 1 is attached to a stand 2 having a cross member disposed in a substantially horizontal direction by using the attachment 11 provided on the rear surface of the casing 10, and a terminal 3 is inserted in an insertion port 100 opened on an upper surface (first surface) 10*a* and a lower surface (second surface) 10*b* facing each other.

Two insertion holes 101 are opened on the front surface of the casing 10 in the terminal removable device 1, and a protrusion 120 of a movable member 12 protrudes from each insertion hole 101 to the outside of the casing 10. The protrusion 120 of the movable member 12 has a columnar shape and is used as a push button that can be pushed to the inside of the casing 10. Note that FIG. 1 illustrates the protrusion 120 positioned at an upper position in a held-down state, and the protrusion 120 positioned at a lower position not in the held-down state. Each of the upper side surface and the lower side surface of the columnar protrusion 120 is provided with a display 120*a* which is a rectangular surface having long sides formed along an axial direction, and the rectangular surface being the display 120*a* is colored in a conspicuous color such as green or silver. The display 120*a* has a function of displaying the position of the movable member 12 that moves forward and rearward. The user can recognize the position of the protrusion 120 of the movable member 12 by viewing the exposure situation of the colored display 120*a*. Further, on the front surface of the casing 10, a viewing assist groove 102 is formed as a groove-shaped notch at a position corresponding to the display 120*a* around the insertion hole 101, so as to make the display 120*a* easily visible. The surface of the bottom of the formed viewing assist groove 102 is a reflecting portion (viewing assist portion) 102*a* subjected to processing such as mirror finishing. The color of the exposed display 120*a* is reflected by the reflecting portion 102*a* of the viewing assist groove 102, thereby enabling the user to indirectly view the display 120*a* and easily view the exposure situation of the display 120*a*. The display 120*a* is exposed from the casing 10 more greatly when the movable member 12 is positioned on the front side (second position) than when the movable member 12 is positioned on the rear side (first position). That is, as the movable member 12 moves from the front side to the rear side, the greatly exposed display 120*a* is hidden in the casing 10, or the exposed portion thereof is reduced in size.

Figure 4:
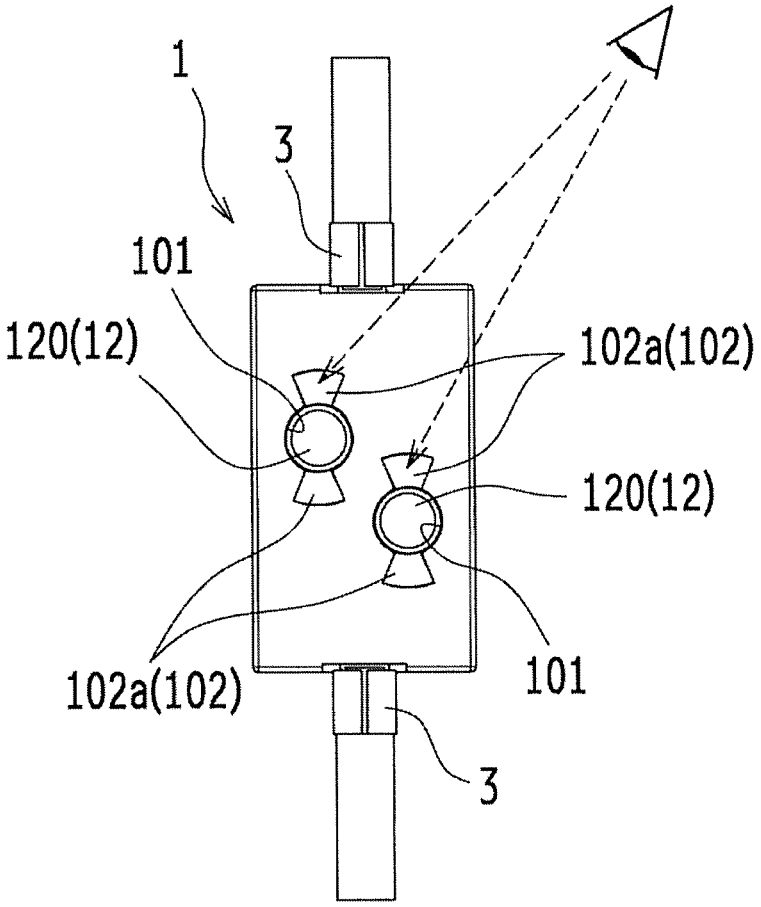
FIG. 4 is a schematic view illustrating an example of the appearance of the terminal removable device according to the present application and a line of sight of a user.

The reflecting portion 102*a* will be further described. FIG. 4 is a schematic view illustrating an example of the external appearance of the terminal removable device 1 and a line of sight of a user according to the present application. FIG. 4 schematically illustrates a situation in which the user is viewing the reflecting portion 102*a* of the terminal removable device 1. As described above, with the color of the exposed display 120*a* being reflected by the reflecting portion 102*a*, the user can indirectly view the display 120*a*

More specifically, as illustrated in FIG. 4, even when the line of sight of the user is at a position in front of or diagonal to the terminal removable device 1 where the display 120*a* of the movable member 12 is not directly visible, the display 120*a* is indirectly visible by viewing the reflecting portion 102*a*. Moreover, the display 120*a* or the reflecting portion 102*a* of each movable member 12 in the terminal removable device 1 becomes visible at the same time from the line of sight illustrated in FIG. 4, so that improvement in workability and convenience for the user can be expected.

Figure 5:
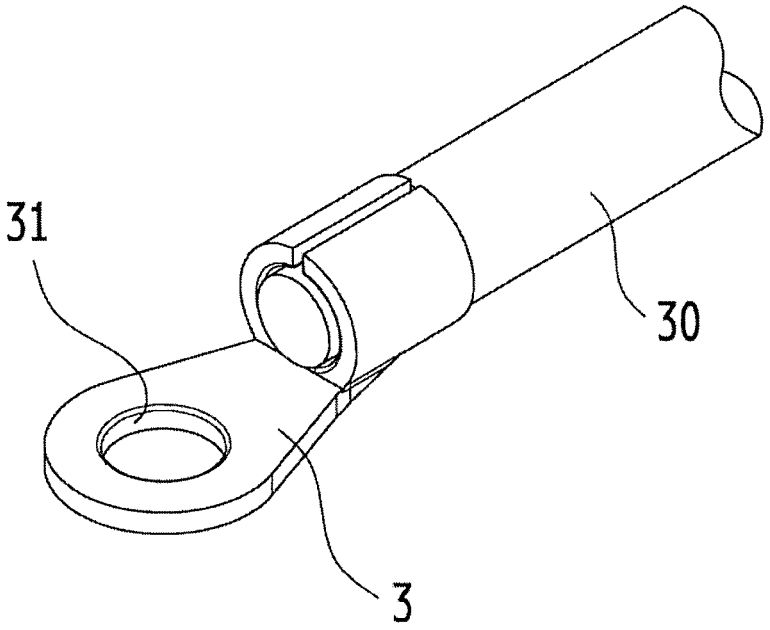
FIG. 5 is an external perspective view illustrating an example of a terminal usable for the terminal removable device according to the present application.

The description returns to the configuration example. FIG. 5 is an external perspective view illustrating an example of a terminal 3 usable for the terminal removable device 1 according to the present application. As illustrated in FIG. 5, the terminal 3 removable from the terminal removable device 1 is attached to the tip of a wire rod 30 such as a power line or a signal line in a caulked state. Here, a round terminal having a flat annular shape with a latching hole 31 opened therein is exemplified as the shape of the terminal 3, but the present invention is not limited thereto, and it is possible to use the terminal 3 having various shapes, such as a terminal having a rectangular shape in a plan view. The terminal 3 portion is formed of a conductor such as metal, and the wire rod 30 is formed by covering a conductor such as one or a plurality of metal wires with an insulator in a single or a multiple manner.

Figure 6:
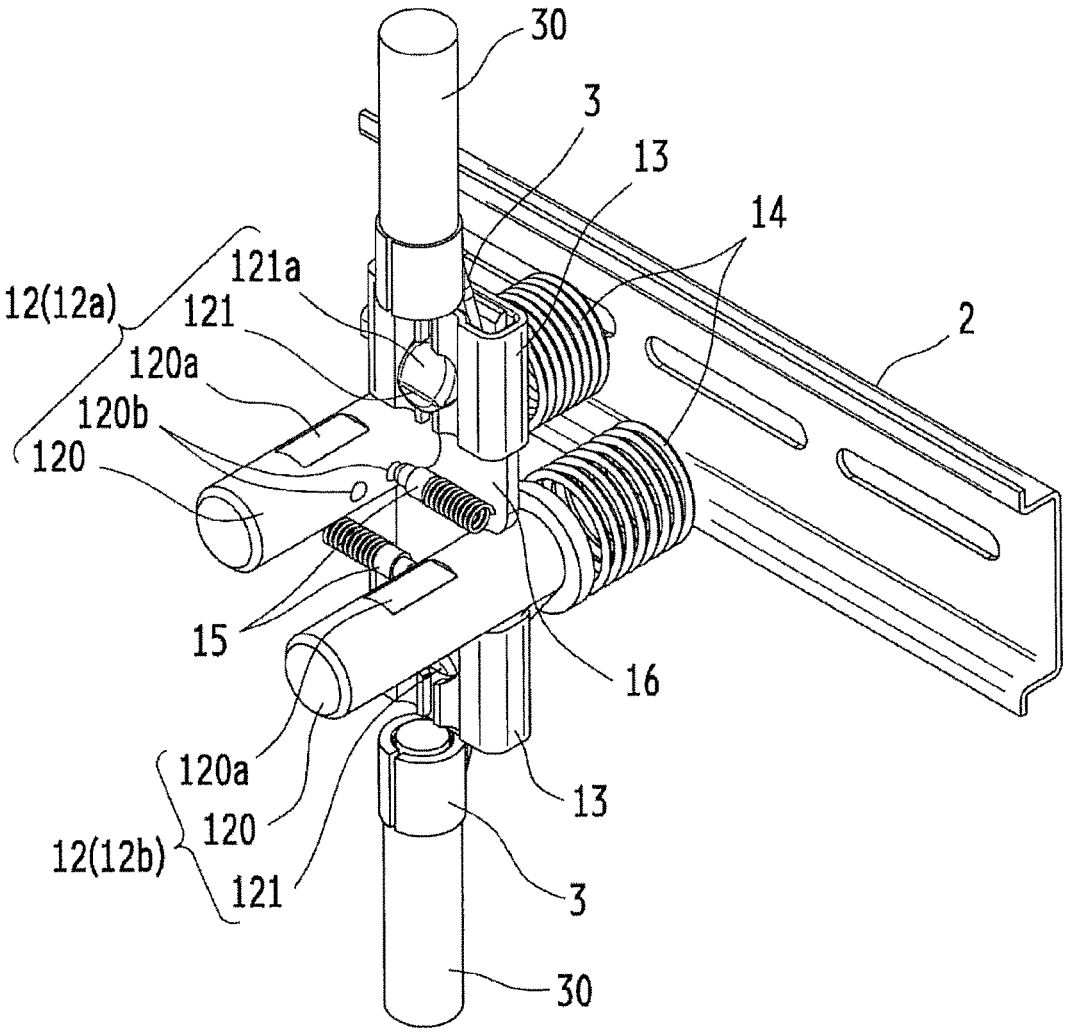
FIG. 6 is a schematic perspective view illustrating an internal structure and a stand of the terminal removable device according to the present application.

FIG. 6 is a schematic perspective view illustrating an internal structure and the stand 2 of the terminal removable device 1 according to the present application. In FIG. 6, the casing 10 of the terminal removable device 1 has been removed, and the internal structure is illustrated as seen from diagonally forward above. In addition, the cross member of the stand 2 is illustrated so that the positional relationship with the external structure can be grasped with ease. A metallic insertion guide 13 for guiding the terminal 3 inserted from the insertion port 100 in the casing 10 is each disposed above and below the inside of the casing 10 in the terminal removable device 1. The terminal 3 inserted while guided by the insertion guide 13 is pressed so as to abut on a metallic connection member 16 that electrically connects each of the upper and lower terminals 3 and is held by the insertion guide 13. The insertion guide 13 is formed by bending both ends of a rectangular metal plate inward so as to abut on the center of the metal plate. The inserted terminal 3 is guided by the bent portion of the metal plate, which forms the insertion guide 13, so as not to be shifted to the right or left. Further, the insertion guide 13 holds the terminal 3 by pressing the inserted terminal 3 with both bent ends.

FIG. 6 illustrates a state where a latching portion 121 of the movable member 12 is inserted into the latching hole 31 in the terminal 3 inserted while guided by the insertion guide 13, and the terminal 3 is latched by the latching portion 121. The movable member 12 is movable forward and rearward, and an urging member 14 such as a compression coil spring which urges the movable member 12 forward is disposed behind the movable member 12. On the side surface of the protrusion 120 of the movable member 12, two recesses 120*b* are bored, the recesses 120*b* being recessed in a spherical crown shape and arranged in the axial direction of the columnar protrusion 120. The side of the movable member 12 is provided with a touch pin 15 which is urged in a direction toward the movable member 12 by the compression coil spring. The tip of the touch pin 15 is formed to project in a spherical crown shape so as to be fitted into the recess 120*b* bored in the protrusion 120 of the movable member 12. Then, when the movable member 12 is positioned on the rear side (first position) in a front-rear movable range, the tip of the touch pin 15 is fitted into the recess 120*b* in front of the movable member 12. Further, when the movable member 12 moves forward from the rear side (first position) within the movable range and is positioned at the front side (second position), the tip of the touch pin 15 is fitted into the recess 120*b* behind the movable member 12. When the touch pin 15 is fitted into the front and rear recesses 120*b* formed in the protrusion 120 of the movable member 12, a so-called click sound ("click") is generated. When fitting the touch pin 15 and removing the touch pin 15 from the fitted state, the user can perceive a change in operation feeling. Due to such changes in sound and operation feeling, the user can easily recognize the arrival or departure of the movable member 12 at or from the rear-side position (first position) to be a bottom dead center or the front-side position (second position) to be the top dead center. For the sake of convenience of description, the position on the rear side to be the bottom dead center where the touch pin 15 is fitted into the recess 120*b* is described as the first position, and the position on the front side to be the top dead center is described as the second position. However, in the terminal removable device 1 according to the present application, the first position indicates a position where the latching of the terminal 3 is released or a position where the terminal 3 can be inserted, and the second position is a position where the terminal 3 can be latched. That is, the bottom dead center is not necessarily the first position, and the top dead center is not necessarily the second position.

Figure 7A:
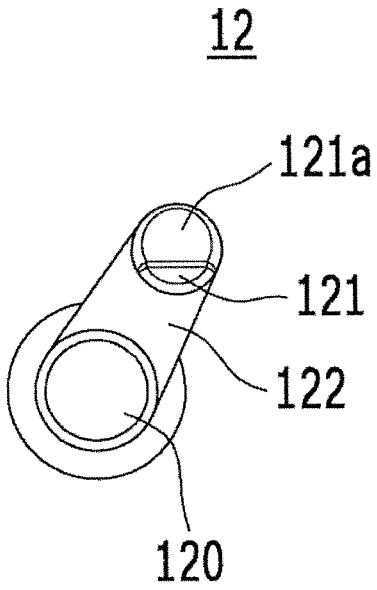
FIGS. 7A and 7B are schematic external views each showing an example of an appearance of a movable member used in the terminal removable device according to the present application.
Figure 7B:
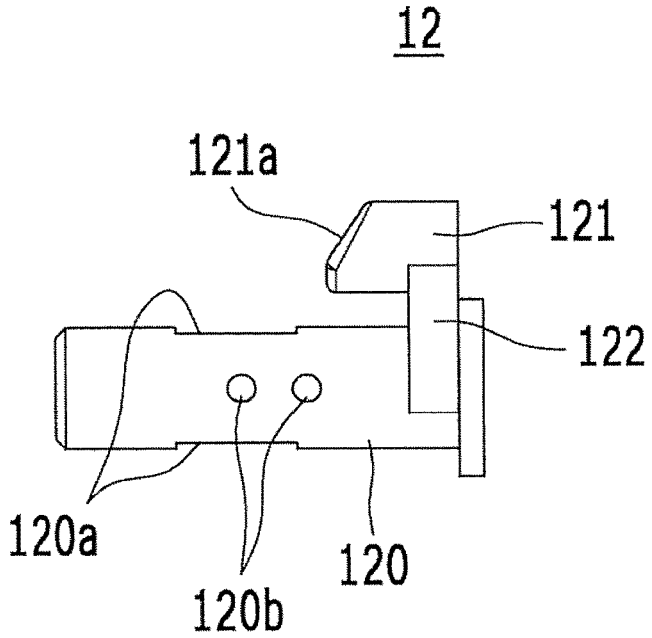

The movable member 12 will be described in detail. FIGS. 7A and 7B are schematic external views each showing an example of the appearance of the movable member 12 used in the terminal removable device 1 according to the present application. FIG. 7A is a front view, and FIG. 7B is a right side view. The movable member 12 is formed in a substantially J-shape, connecting the rear end of the columnar protrusion 120 and the rear end of the columnar latching portion 121 having a shorter axial length than that of the protrusion 120 with a plate-shaped coupling portion 122. As described above, the protrusion 120 of the movable member 12 has the display 120*a* and the recess 120*b* on the side surface. The columnar latching portion 121 has a tapered shape with an inclined abutment surface 121*a* formed from the bottom surface to be the front surface to the upper side surface. When the terminal 3 is inserted into the casing 10, the inserted terminal 3 comes into contact with the abutment surface 121*a* of the latching portion 121. When the user further pushes the terminal 3, the movable member 12 pressed to the terminal 3 moves rearward against the urging force of the urging member 14. Details of the operation of the terminal removable device 1 including the movable member 12 will be described later. As thus described, since the movable member 12 achieves the protrusion 120 used for the operation by the user and the latching portion 121 for latching the terminal 3 with one member, it is possible to achieve overall reduction in number of parts in the terminal removable device 1 and exert various effects such as reduction in manufacturing cost, reduction in management cost, and improvement in maintenance performance.

Figure 8:
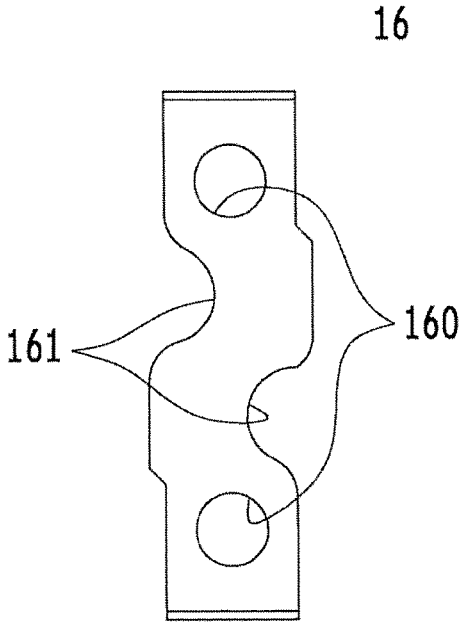
FIG. 8 is a schematic front view illustrating an example of an appearance of a connection member used in the terminal removable device according to the present application.

The connection member 16 will be described in detail. FIG. 8 is a schematic front view illustrating an example of the appearance of the connection member 16 used in the terminal removable device 1 according to the present application. The connection member 16 is formed of a conductor such as a metal material having a rectangular plate shape. In the connection member 16, through holes 160 having a circular shape in a plan view are opened near both longitudinal ends. When the terminal 3 is inserted into the casing 10, the inserted terminal 3 is superimposed on the connection member 16, and the latching hole 31 in the terminal 3 and the through hole 160 in the connection member 16 come into a communicating state. Then, the latching portion 121 of the movable member 12 is inserted and fitted into the latching hole 31 in the terminal 3 and the through hole 160 in the connection member 16 which are in the communicating state, whereby the movable member 12 latches the terminal 3. Further, curved portions 161 curved so as to be recessed inward are formed on both sides which are the long sides of the rectangular connection member 16. With the curved portion 161 being formed at positions not facing each other on both sides, the connection member 16 is, as a whole, curved in a substantially S shape. The respective curved portions 161 formed at the positions not facing each other correspond to the positions of the protrusions 120 of the movable member 12, and are formed such that the connection member 16 does not come into contact with the protrusion 120. That is, the connection member 16 linearly connects the terminals 3 inserted from both above and below, and has a sufficient width to achieve sufficient power transmission performance. Moreover, due to formation of the curved portions 161 at the positions not facing each other on both sides, the connection member 16 ensures a sufficient width and achieves overall reduction in size of the terminal removable device 1 without increasing the arrangement interval of the movable members 12.

Returning to FIG. 6, the arrangement of each member accommodated in the casing 10 in the terminal removable device 1 will be described. The terminals 3 are inserted into the insertion ports 100 formed on the upper surface (first surface) 10*a* and the lower surface (second surface) 10*b* which are facing surfaces of the casing 10. The terminals 3 inserted from the upper and lower insertion ports 100 are latched by the upper and lower movable members 12. Specifically, the terminal 3 inserted from the insertion port 100 on the upper surface 10*a* is latched with the latching portion 121 of the movable member 12 positioned on the upper side (hereinafter referred to as a first movable member 12*a* as necessary), and the terminal 3 inserted from the insertion port 100 on the lower surface 10*b* is latched with the latching portion 121 of the movable member 12 positioned on the lower side (hereinafter referred to as a second movable member 12*b* as necessary). The protrusion 120 of the first movable member 12*a* is disposed so as to be positioned on the lower surface (second surface) 10*b* side and on the left side to the connection member 16 from the latching portion 121 of the first movable member 12*a*, so that the protrusion 120 is positioned diagonally left below the latching portion 121 that latches the terminal 3. Further, the protrusion 120 of the second movable member 12*b* is disposed so as to be positioned on the upper surface (first surface) 10*a* side and on the right side to the connection member 16 from the latching portion 121 of the second movable member 12*b*, so that the protrusion 120 is positioned diagonally right above the latching portion 121 that latches the terminal 3. The protrusion 120 of the first movable member 12*a* that latches the terminal 3 inserted from the upper surface 10*a* is positioned diagonally left above the protrusion 120 of the second movable member 12*b* that latches the terminal 3 inserted from the lower surface 10*b*. That is, the first movable member 12*a* and the second movable member 12*b* are arranged such that a straight line connecting the protrusion 120 of the first movable member 12*a* and the protrusion 120 of the second movable member 12*b* is oblique to a straight line connecting the insertion port 100 on the first surface side and the insertion port 100 on the second surface side. The protrusion 120 of the first movable member 12*a* used for latching the terminal 3 inserted from the upper surface 10*a* is positioned above the protrusion 120 of the second movable member 12*b* used for latching the terminal 3 inserted from the lower surface 10*b*. Therefore, the user viewing the terminal removable device 1 views the terminal removable device 1 in the state illustrated in FIG. 3 (particularly, FIG. 3B), so that it is possible to intuitively grasp the terminal 3 and the protrusion 120 of the movable member 12 related to the terminal 3, which is excellent in convenience. Further, since the protrusion 120 of the first movable member 12*a* and the protrusion 120 of the second movable member 12*b* are disposed so as to be positioned not in a completely vertical direction but in an oblique direction, the vertical length of the terminal removable device 1 is decreased to enable reduction in size of the terminal removable device 1. Moreover, since the respective protrusions 120 are disposed so as to be positioned on the respective curved portions 161 formed at the positions not facing each other on both sides of the connection member 16, the horizontal length of the terminal removable device 1 is decreased to enable reduction in size of the terminal removable device 1.

Next, the operation of the terminal removable device 1 according to the present application will be described. FIGS. 9, 10, 11, and 12 are schematic side views showing the internal structure of the terminal removable device 1 according to the present application. FIGS. 9 to 12 show the operation of the terminal removable device 1. As a matter of convenience of the drawings, FIGS. 9 to 12 are illustrated such that the upward direction in the terminal removable device 1 is the right direction in the drawing.

Figure 9:
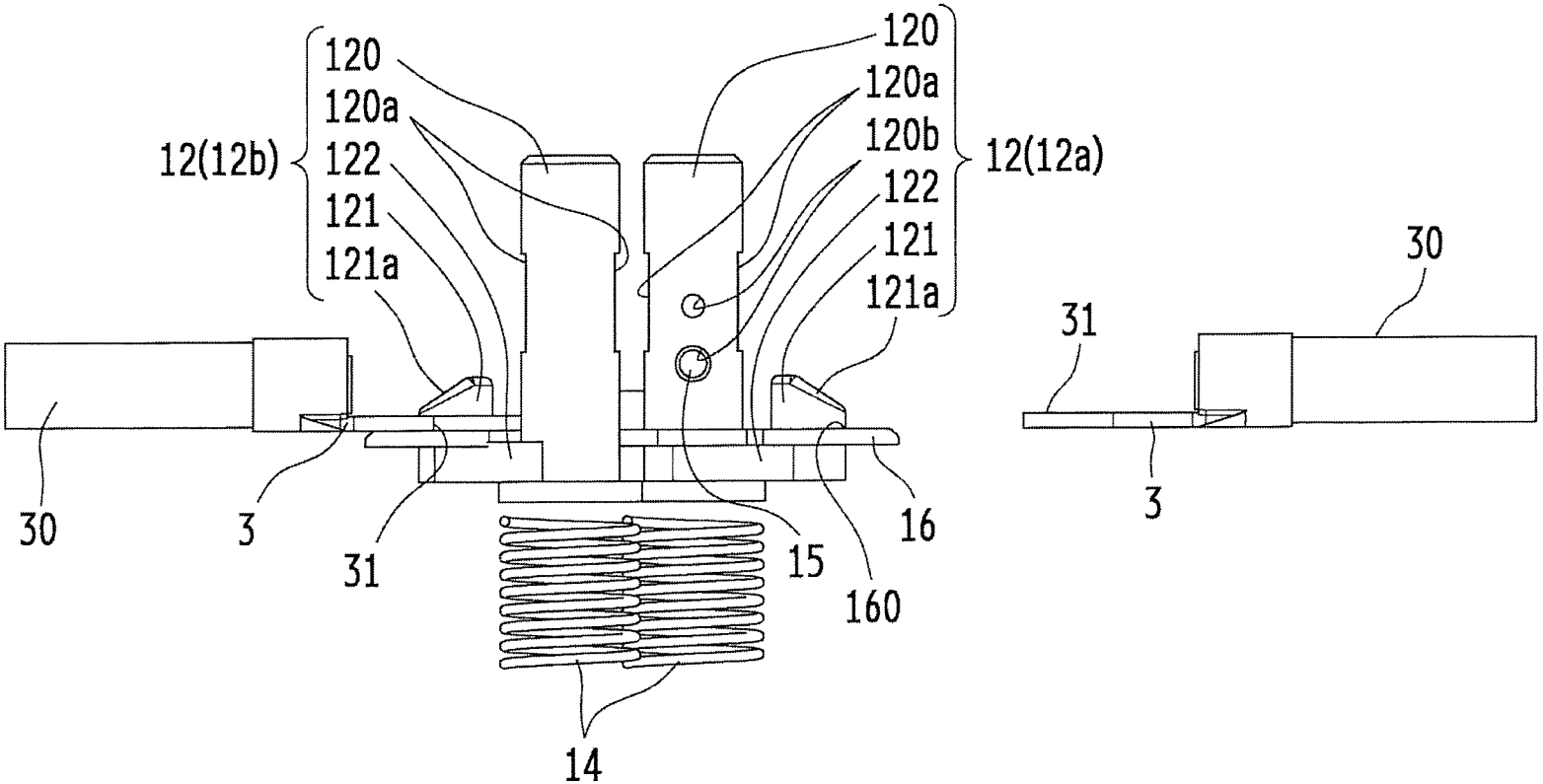
FIG. 9 is a schematic side view illustrating the internal structure of the terminal removable device according to the present application.

FIG. 9 illustrates a state where the terminal 3 is about to be inserted into the insertion port 100 from the upper surface 10*a* side (the right side in FIG. 9) of the terminal removable device 1. Note that the terminal 3 has already been inserted on the lower surface 10*b* side (the left side in FIG. 9). In FIG. 9, both the first movable member 12*a* and the second movable member 12*b* are positioned at the second position that is the front of the front-rear movable range (the upper side in FIG. 9), and the tip of the spherical crown shape of the touch pin 15 is fitted in the recess 120*b* on the rear side of each protrusion 120. In the state illustrated in FIG. 9, the display 120*a* of the protrusion 120 of the first movable member 12*a* and the display 120*a* of the protrusion 120 of the second movable member 12*b* are both exposed so as to be easily visible from the outside of the casing 10. Hence the user can recognize that each movable member 12 is positioned at the second position and is in a locked state.

Figure 10:
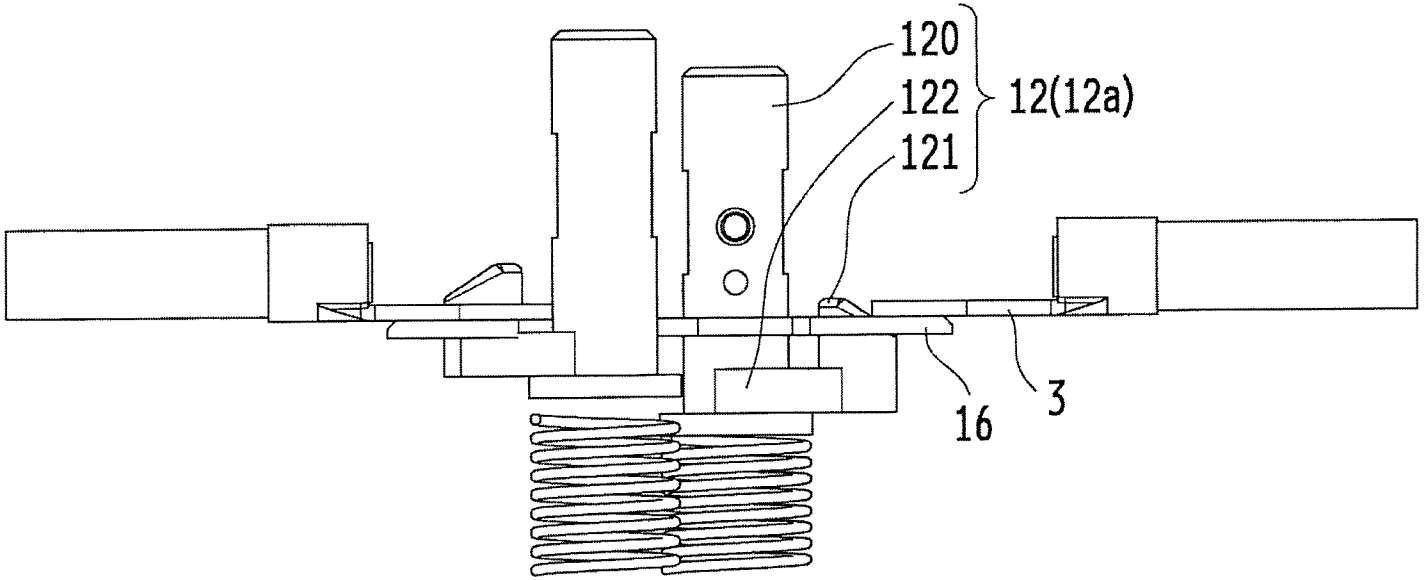
FIG. 10 is a schematic side view illustrating the internal structure of the terminal removable device according to the present application.

FIG. 10 illustrates a state where the terminal 3 is inserted along the insertion guide 13 from the state illustrated in FIG. 9, to abut on the abutment surface 121*a* of the latching portion 121 of the first movable member 12*a*, and the terminal 3 is further pushed from the state where the tip of the terminal 3 abuts on the abutment surface 121*a*. By pushing the terminal 3 from the state where the tip of the terminal 3 abuts on the abutment surface 121*a*, the inclined abutment surface 121*a* is pressed and the movable member 12 is pushed to the rear first position or the vicinity of the first position. The movable member 12 is urged forward by the urging member 14, but by pushing the terminal 3, the movable member 12 moves rearward against the urging force of the urging member 14. In the state illustrated in FIG. 10, the display 120*a* of the protrusion 120 of the first movable member 12*a* is hidden inside the casing 10 or the exposed portion thereof is reduced in size, so that the user can recognize that the movable member 12 is separated from the second position and the locked state is released. Further, FIG. 10 illustrates a state where the touch pin 15 is fitted in the recess 120*b* on the front side of the protrusion 120 of the movable member 12 having moved to the first position. However, it is not always necessary to hold the member 12 at the first position by fitting of the touch pin 15. Instead of pushing the abutted terminal 3, the user may push down the protrusion 120 against the urging force of the urging member 14 to move the movable member 12 from the second position to the first position, and the terminal 3 may be inserted in a state where the movable member 12 has been moved to the first position. The operation of pushing down the protrusion 120 of the movable member 12 has good workability as compared to the pulling-up operation, and it is possible to easily perform the operation of pushing down the protrusion 120.

Figure 11:
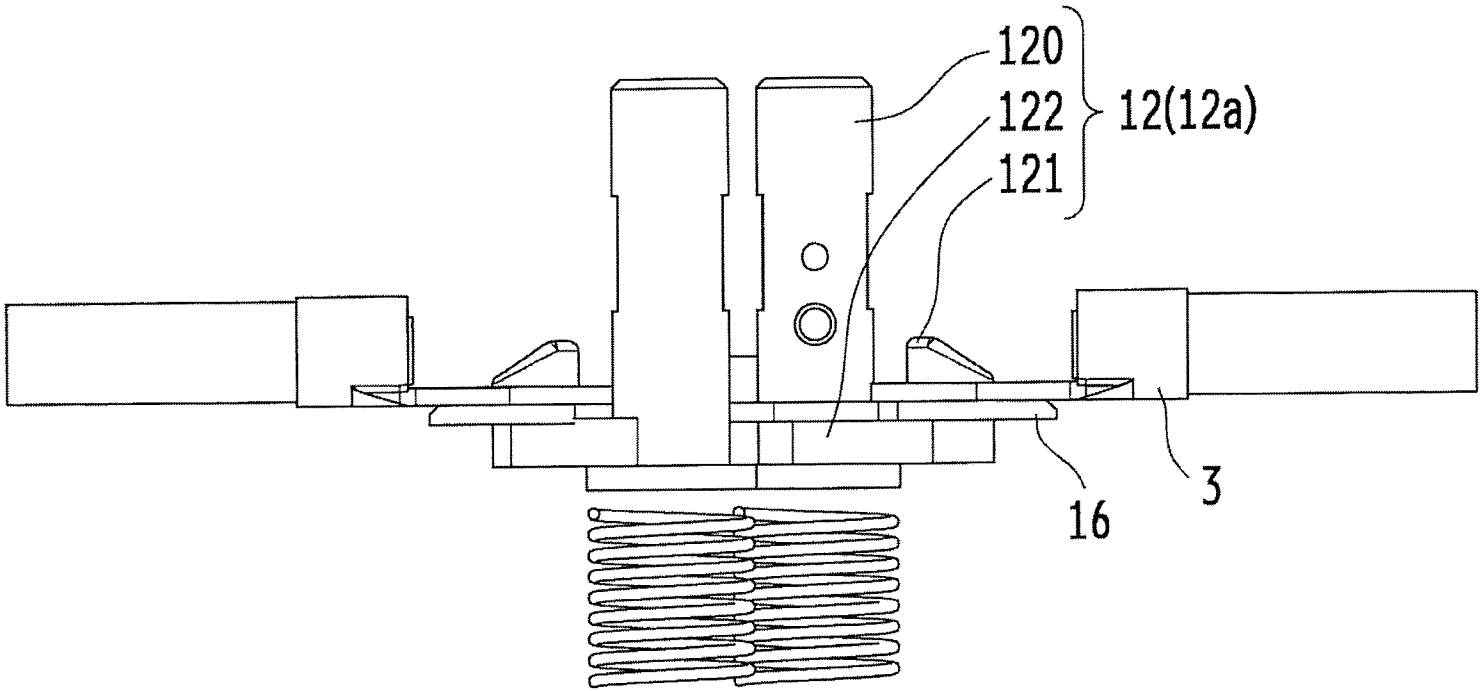
FIG. 11 is a schematic side view illustrating the internal structure of the terminal removable device according to the present application.

FIG. 11 illustrates a state where the terminal 3 is pushed further along the insertion guide 13 from the state illustrated in FIG. 10 so that the terminal 3 is superimposed on the connection member 16, and the latching hole 31 in the terminal 3 and the through hole 160 in the connection member 16 are in the communicating state. By the latching hole 31 in the terminal 3 and the through hole 160 in the connection member 16 coming into the communicating state, the movable member 12 moves from the rear first position to the front second position within the movable range, and the latching portion 121 of the movable member 12 is inserted and fitted into the latching hole 31 in the terminal 3 and the through hole 160 in the connection member 16. The latching portion 121 of the movable member 12 is inserted and fitted into the latching hole 31 in the terminal 3 and the through hole 160 in the connection member 16 in the communicating state, so that the movable member 12 latches the terminal 3. Since the lower side surface (the side surface opposite to the direction in which the terminal 3 is inserted) of the latching portion 121 is not inclined, even when a force is applied in a direction to withdraw the terminal 3, the movable member 12 does not move and is in the locked state where the terminal 3 is held at the inserted position. Since the movable member 12 is urged forward by the urging member 14, when the latching hole 31 in the terminal 3 and the through hole 160 in the connection member 16 come into the communicating state, the movable member 12 is pushed forward by the urging force of the urging member 14. In a mode in which the movable member 12 is designed to be held at the rear first position by the touch pin 15 when the latching hole 31 in the terminal 3 and the through hole 160 in the connection member 16 communicate with each other, a simple operation of removing the touch pin 15 from the recess 120*b* is required. In the state illustrated in FIG. 11, the display 120*a* of the protrusion 120 of the first movable member 12*a* is exposed so as to be easily visible from the outside of the casing 10, and the user can recognize that the first movable member 12*a* is positioned at the second position and is in a locked state.

Figure 12:
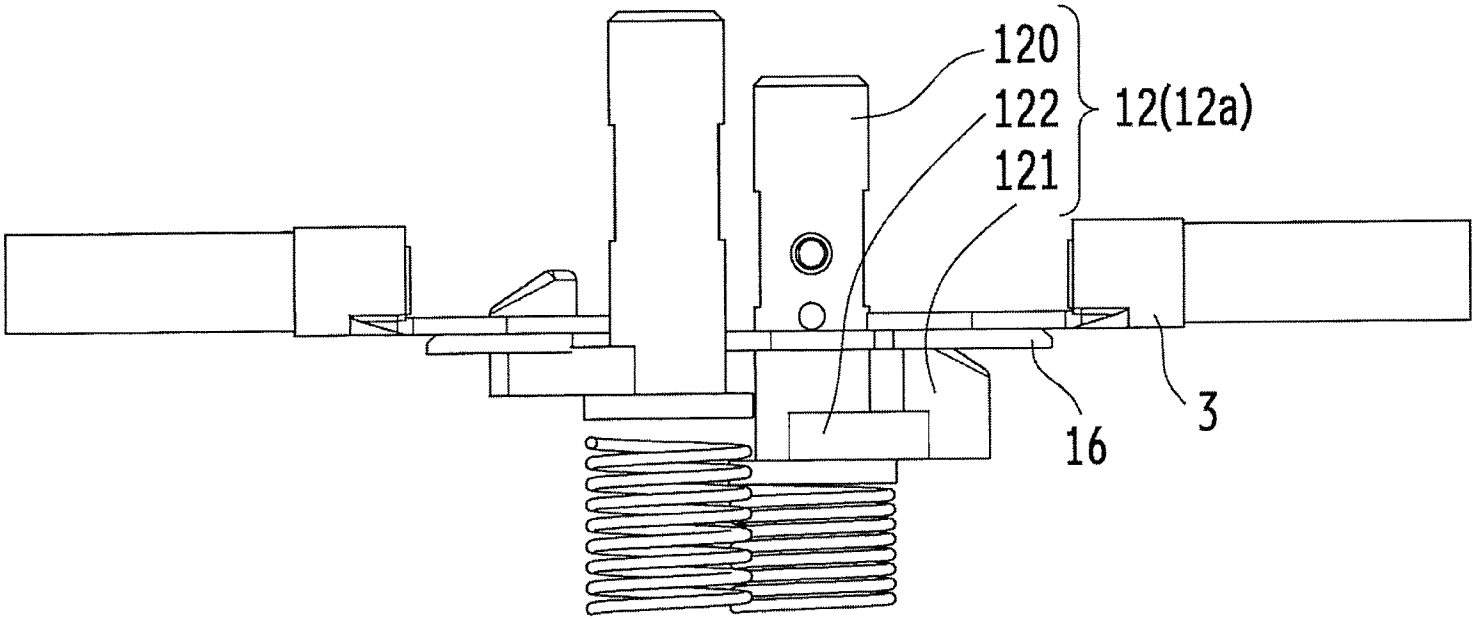
FIG. 12 is a schematic side view illustrating the internal structure of the terminal removable device according to the present application.

FIG. 12 illustrates a state where the first movable member 12*a* is pushed from the front second position to the rear first position from the state illustrated in FIG. 11. The user pushes down the protrusion 120 of the movable member 12 positioned at the second position against the urging force of the urging member 14, so that the movable member 12 moves from the second position to the first position, and the latching by the latching portion 121 of the movable member 12 is released. In the state illustrated in FIG. 12, the user can withdraw the terminal 3, from which the latching by the latching portion 121 is released, from the terminal removable device 1. The operation of releasing the latching is the operation of pushing down the protrusion 120 of the movable member 12, and is thus simple and operability is good as compared to the pulling-out operation. In the state illustrated in FIG. 12, the display 120*a* of the protrusion 120 of the first movable member 12*a* is hidden inside the casing 10 or the exposed portion thereof is reduced in size, so that the user can recognize that the movable member 12 is separated from the second position and the locked state is released.

As described above, the terminal removable device 1 according to the present application can mount and remove the terminal 3 by a simple operation with the movable member 12 including the protrusion 120 and the latching portion 121. Further, such improvement in operability can be achieved with one movable member 12, thereby achieving overall reduction in number of parts in the terminal removable device 1. Moreover, the terminal removable device 1 according to the present application exerts various excellent effects such as miniaturization of the terminal removable device 1, visibility of the locked state, and the like.

Second Embodiment

A second embodiment of the terminal removable device 1 according to the present application will be described. The second embodiment is a mode in which six terminals 3 can be inserted into the terminal removable device 1 in the first embodiment. In the second embodiment, substantially the same components as those in the first embodiment are denoted by the same reference numerals, the directions are assumed to be same as those in the first embodiment, and the description thereof will be omitted.

Figure 13:
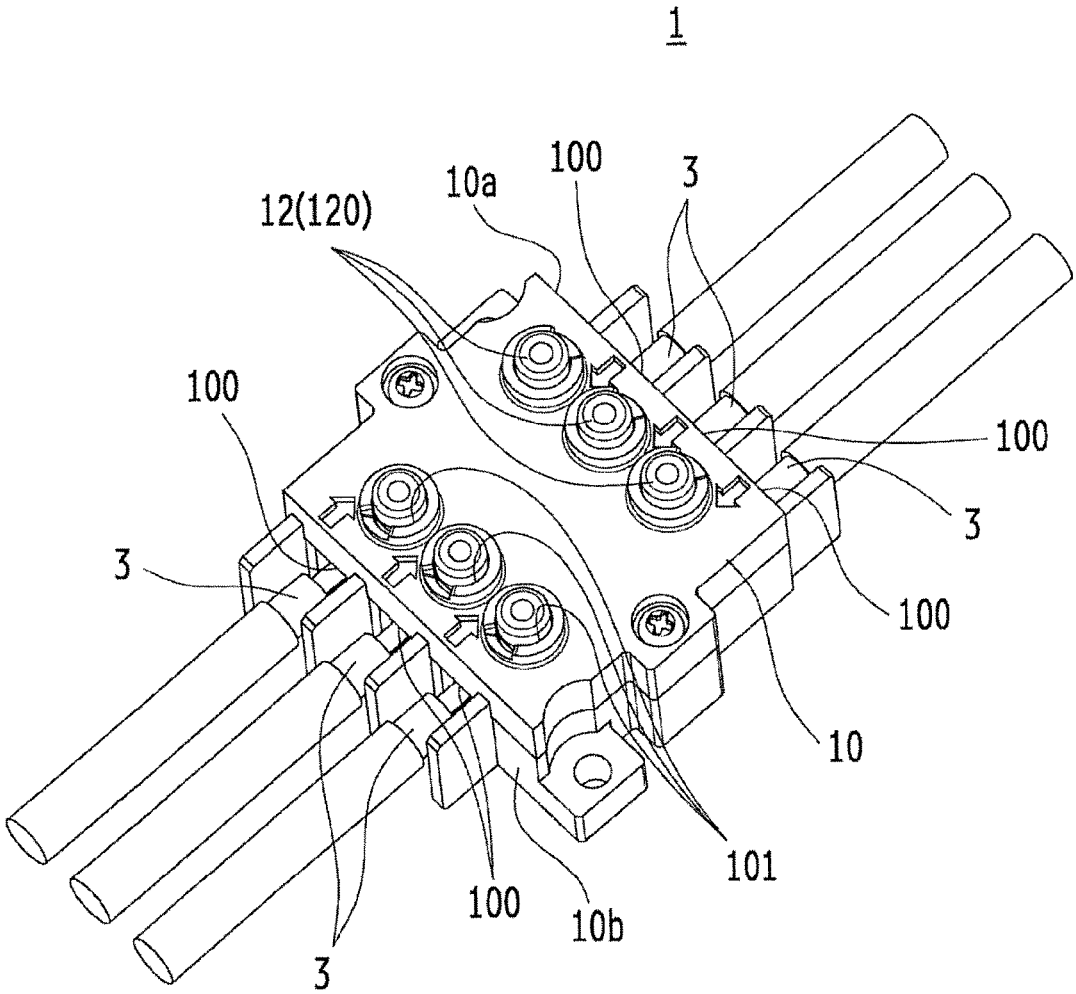
FIG. 13 is a schematic perspective view illustrating an example of the appearance of the terminal removable device according to the present application.

FIG. 13 is a schematic perspective view illustrating an example of the appearance of the terminal removable device 1 according to the present application. FIG. 13 illustrates the appearance of the terminal removable device 1 according to the second embodiment as seen from diagonally forward below. In the casing 10 in the terminal removable device 1 according to the second embodiment, three insertion ports 100 are opened on each of the upper surface 10*a* and the lower surface 10*b* (a total of six insertion ports 100 are opened), and FIG. 13 illustrates a mode in which the terminal 3 is inserted in each insertion port 100. On the front surface of the casing 10, a depression of an arrow shape indicating the direction in which the terminal 3 is inserted is provided.

A total of six insertion holes 101 are opened on the front surface of the casing 10 in the terminal removable device 1 so as to correspond to the respective insertion ports 100, and the protrusion 120 of the movable member 12 protrudes from each insertion hole 101 to the outside of the casing 10. In the casing 10, the connection member 16 connecting the terminals 3 can be designed as appropriate, and all the terminals 3 may be electrically connected, or any sets of terminals 3 may be connected to each other. Further, not only the terminals 3 are simply connected to each other, but an electric circuit may be provided as necessary, and the terminal 3 and the electric circuit may be connected to each other. The other configuration and operation are substantially the same as those of the first embodiment, and the description thereof will thus be omitted.

As described above, the terminal removable device 1 according to the present application can be developed into a mode in which not only two terminals 3 are connected, but also six terminals 3, or the number of terminals other than six, are connected. Further, in the second embodiment, the protrusions 120 of the movable members 12 are arranged in parallel or orthogonal to the long side and the short side of the front surface of the rectangular casing 10. That is, the protrusions 120 are not necessarily required to be arranged obliquely to the straight line connecting the insertion ports 100 facing each other, and the arrangement of the protrusions 120 can be developed into various forms such as parallel or orthogonal arrangement.

Third Embodiment

A third embodiment of the terminal removable device 1 according to the present application will be described. The third embodiment is a mode in which, in the first embodiment, two terminals 3 can be inserted into one surface of the terminal removable device 1 and can be further mounted on a substrate (not illustrated). In the third embodiment, substantially the same components as those in the first embodiment are denoted by the same reference numerals, the directions are assumed to be same as those in the first embodiment, and the description thereof will be omitted.

Figure 14A:
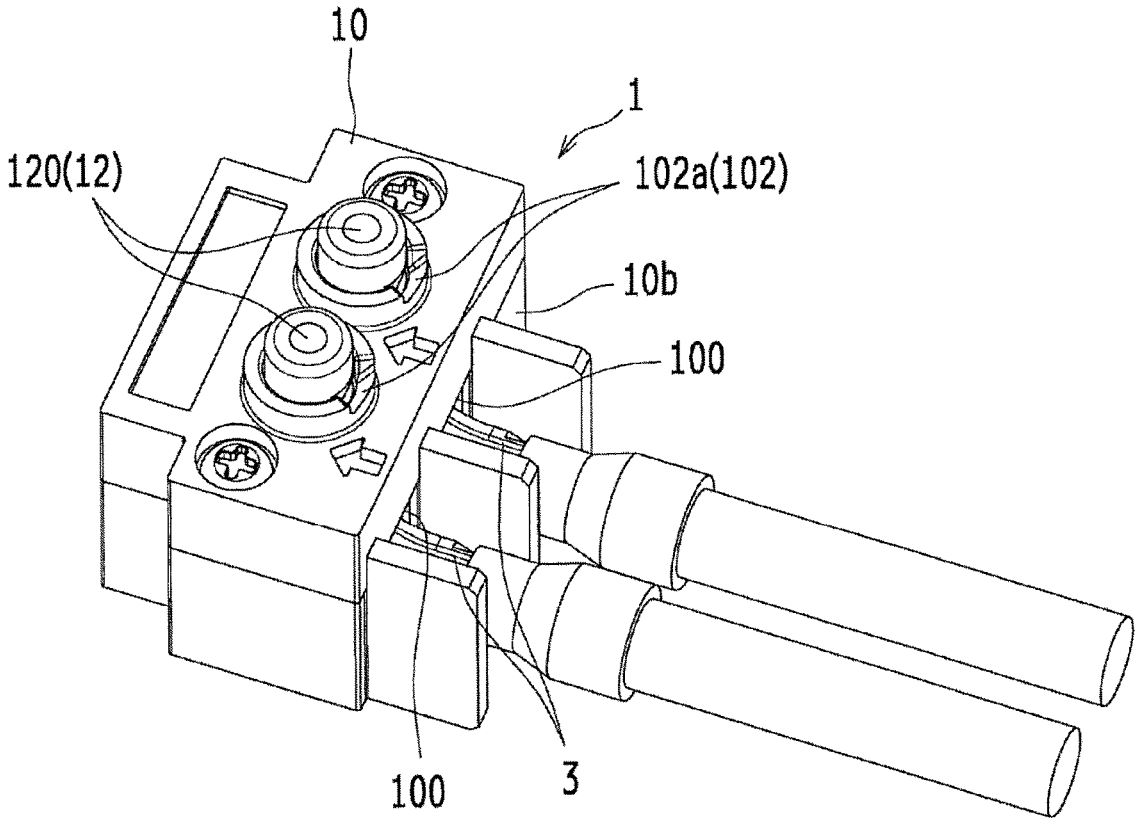
FIGS. 14A and 14B are schematic perspective views each showing an example of the appearance of the terminal removable device according to the present application.
Figure 14B:
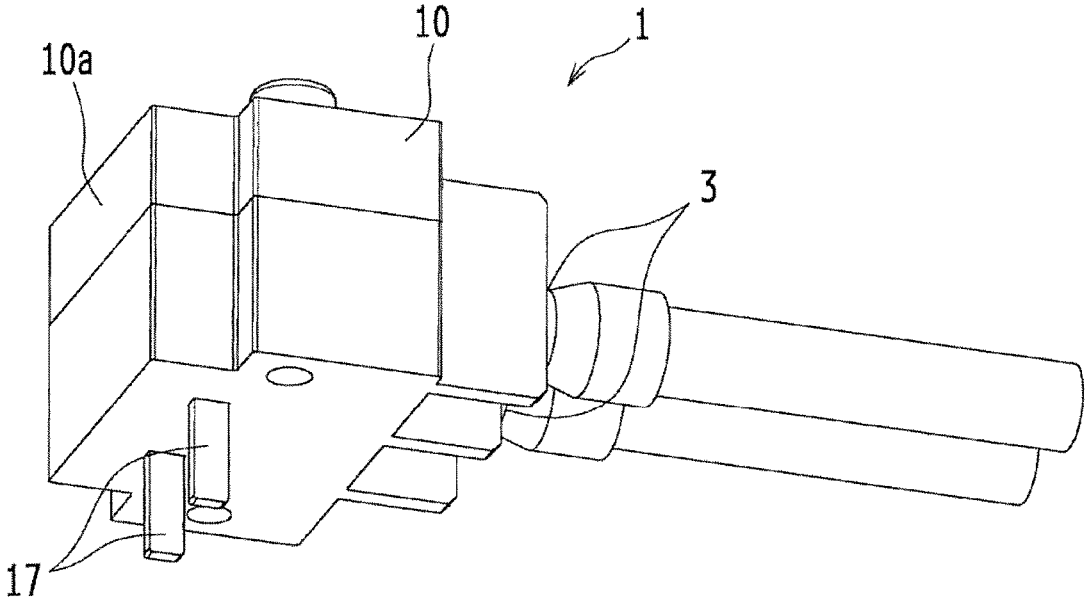

FIGS. 14A and 14B are schematic perspective views each showing an example of the appearance of the terminal removable device 1 according to the present application. FIG. 14A illustrates the appearance of the terminal removable device 1 according to the third embodiment as seen from diagonally forward, and FIG. 14B illustrates the same as seen from diagonally rearward. In the casing 10 in the terminal removable device 1 according to the third embodiment, two insertion ports 100 are opened on the lower surface 10*b*, and FIGS. 14A and 14B show a mode in which the terminal 3 is inserted in each insertion port 100. Note that the insertion port 100 is not opened on the upper surface 10*a*.

Further, two assist terminals 17 are provided on the rear surface of the casing 10 in the terminal removable device 1 by such a method as soldering so that electric device (not illustrated) such as a substrate can be mounted. The two assist terminals 17 are connected to the terminals 3 inside the casing 10.

Figure 15:
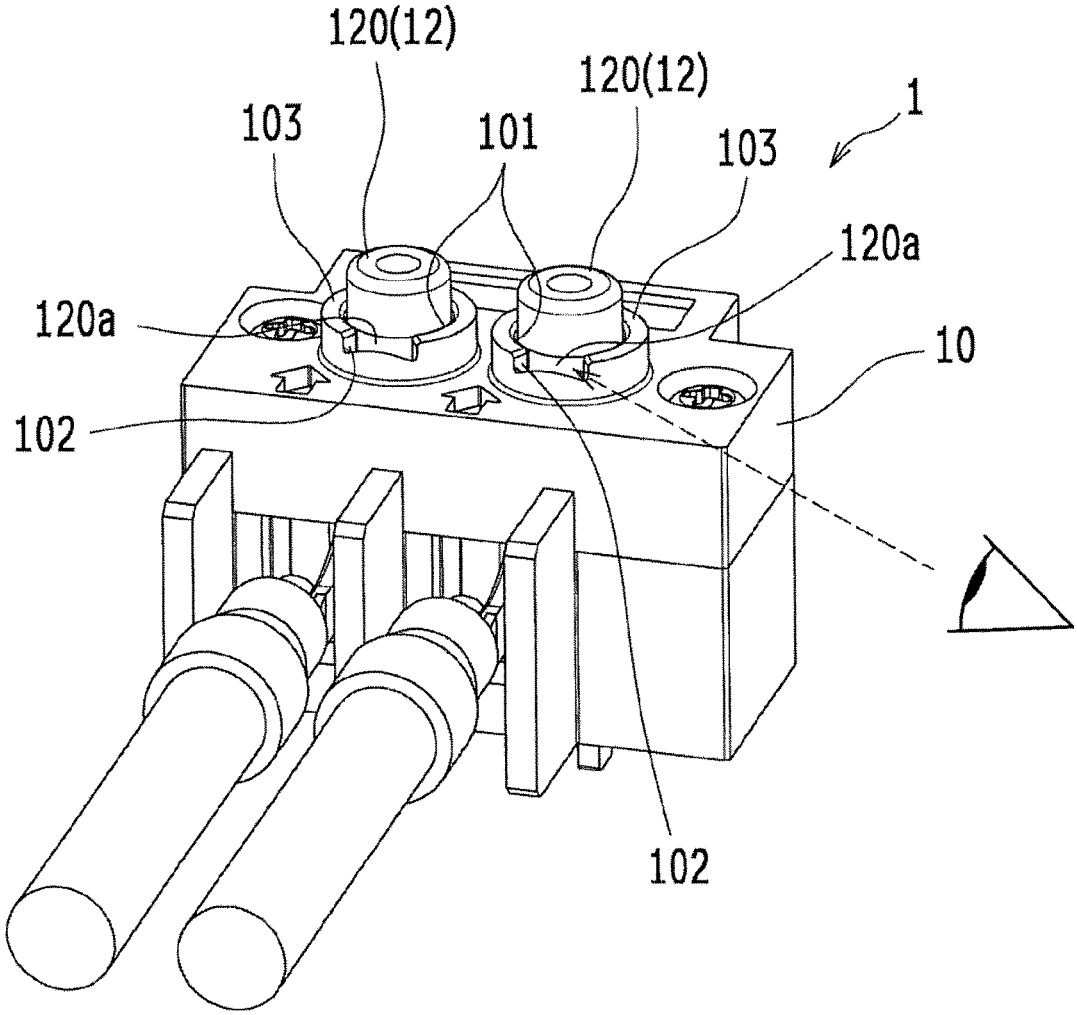
FIG. 15 is a schematic view illustrating an example of the appearance of the terminal removable device according to the present application and a line of sight of the user.
Figure 16:
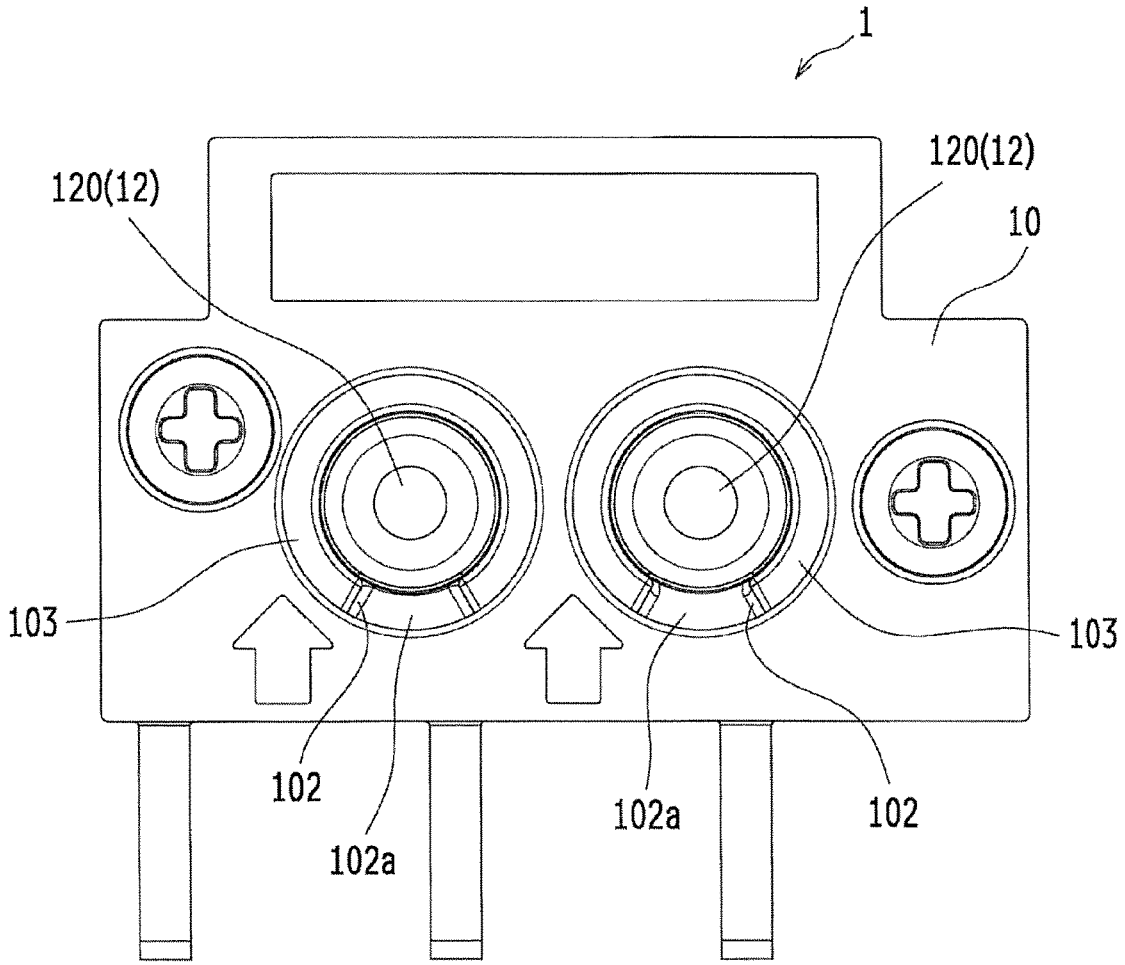
FIG. 16 is a schematic front view illustrating an example of the external appearance of the terminal removable device according to the present application.
Figure 17:
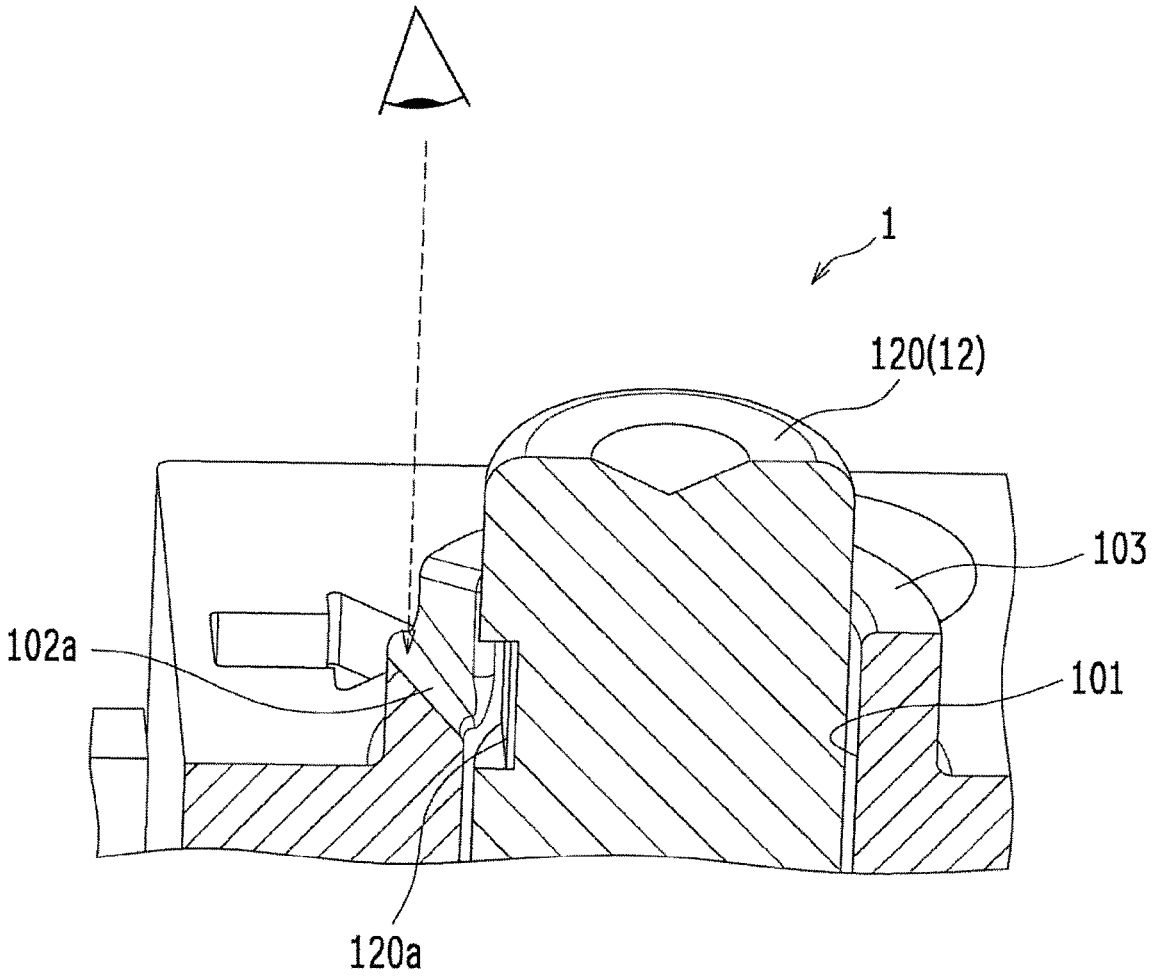
FIG. 17 is a schematic view illustrating an example of the terminal removable device according to the present application and a line of sight of the user.

The viewing assist groove 102 and the reflecting portion 102*a* of the terminal removable device 1 according to the third embodiment will be described. FIG. 15 is a schematic view illustrating an example of the external appearance of the terminal removable device 1 and a line of sight of the user according to the present application. FIG. 15 schematically illustrates the appearance of the terminal removable device 1 as seen from diagonally forward below. Further, FIG. 15 schematically illustrates a situation in which the user is viewing the display 120*a* of the terminal removable device 1. FIG. 16 is a schematic front view illustrating an example of the appearance of the terminal removable device 1 according to the present application. FIG. 17 is a schematic view illustrating an example of the terminal removable device 1 and a line of sight of the user according to the present application. FIG. 17 schematically illustrates a part of the terminal removable device 1, cut by a vertical and front-rear plane, as a cross section seen from the right side. Further, FIG. 17 illustrates a situation in which the user is viewing the reflecting portion 102*a* of the terminal removable device 1. Two insertion holes 101 are formed on the front surface of the casing 10 in the terminal removable device 1, and a cylindrical wall portion 103 is provided so as to surround the circumference of each insertion hole 101. In the wall portion 103 surrounding the insertion hole 101, a notch is formed as a viewing assist groove 102 at a position corresponding to the display 120*a* of the protrusion 120 of the movable member 12, i.e., in the lower part of the wall portion 103 in this case. The surface of the bottom of the viewing assist groove 102 is a reflecting portion 102*a* subjected to processing such as mirror finishing.

The visibility of the display 120*a* will be further described. As in the first embodiment, the color of the display 120*a* exposed from the casing 10 is reflected by the reflecting portion 102*a*, so that the user can indirectly view the display 120*a* reflected by the reflecting portion 102*a* other than viewing the display 120*a* directly through the viewing assist groove 102. The other configuration and operation are substantially the same as those of the first embodiment, and the description thereof will thus be omitted.

As described in the first embodiment, in the terminal removable device 1 according to the present application, the insertion port 100 can be opened not only on each of two surfaces facing each other, but can also be opened on just one surface, or on each of three or more surfaces, and the terminal 3 can be inserted in each insertion port 100. In addition to the terminal inserted into the insertion port 100, it is also possible to attach various members such as the assist terminal 17 used for mounting on an external device such as a substrate. Further, the shapes of the viewing assist groove 102 and the reflecting portion 102*a* can be designed as appropriate.

The present invention is not limited to each of the embodiments described above, and can be implemented in various other modes. Therefore, the embodiments described above are merely illustrative in all respects, and should not be interpreted restrictively. The technical scope of the present invention is described by the scope of the claims and is not bound in any way by the contents of the specification. Moreover, all variations and modifications falling within the equivalent scope of the claims are within the scope of the present invention.

For example, the above embodiment shows a mode in which the reflecting portion 102*a* is used as a viewing assist portion for assisting display on the display 120*a*. However, as long as the display on the exposed display 120*a* is indirectly visible, the reflection may be performed by a method other than mirror finishing, for example, by attaching a reflector. Furthermore, the present invention can be developed into various modes such as disposing a light-emitting diode (LED) that is lit in accordance with the position of the movable member 12 and using the LED as a viewing assist portion for assisting the display on the display 120*a*.

The invention claimed is:

1. A terminal removable device comprising:

a casing having an insertion port structured such that a terminal can be inserted therein; and a movable member including a latching portion configured to latch the terminal by moving from a first position to a second position with respect to the terminal inserted into the casing, wherein the movable member includes a protrusion protruding from the casing when the movable member is at the second position, wherein, when the protrusion is pushed down to the casing side, the movable member moves from the second position to the first position to release the latching of the terminal, wherein the number of insertion ports is two or larger, wherein the terminal removable device comprises a connection member configured to electrically connect a plurality of the terminals inserted from the different insertion ports and respectively latched by latching portions of the movable member, and wherein the connection member includes curved portions formed so as to linearly connect the inserted terminals and avoid contact with the movable member.

2. The terminal removable device according to claim 1, wherein the movable member has an abutment surface on which the terminal inserted into the casing abuts, and wherein the movable member is movable from the second position to the first position when the terminal is inserted in a state of abutting on the abutment surface, and the movable member is movable from the first position to the second position when the terminal is inserted to a position at which the terminal can be latched.

3. The terminal removable device according to claim 2, wherein a direction in which the terminal is inserted is orthogonal to a direction in which the movable member moves, and wherein the abutment surface is inclined with respect to the direction in which the terminal is inserted.

4. The terminal removable device according to claim 1, wherein the movable member includes a display configured to visibly display that the movable member is positioned at the second position, and wherein the display is exposed from the casing more greatly when the movable member is positioned at the second position than when the movable member is positioned at the first position.

5. The terminal removable device according to claim 4, wherein the casing includes a viewing assist portion configured to indirectly make the exposed display visible when the display of the movable member is exposed.

6. The terminal removable device according to claim 1, wherein the curved portions of the connection member are formed at positions not facing each other on both sides.

7. The terminal removable device according to claim 1, wherein the casing has a first surface and a second surface facing each other, wherein the insertion port is formed on each of the first surface and the second surface, wherein a first protrusion of a first movable member which latches the terminal inserted from the insertion port on the first surface side is disposed on the second surface side with a latching member, wherein a second protrusion of a second movable member that latches the terminal inserted from the insertion port on the second surface side is disposed on the first surface side with a latching member, and wherein the first movable member and the second movable member are arranged such that a straight line connecting the first protrusion of the first movable member and the second protrusion of the second movable member is oblique to a straight line connecting the insertion port on the first surface side and the insertion port on the second surface side.

8. The terminal removable device according to claim 1, further comprising:

an assist terminal configured to be connected to another electric device, wherein the assist terminal is electrically connected to the terminal inserted into the casing.

9. The terminal removable device according to claim 2, wherein the movable member includes a display configured to visibly display that the movable member is positioned at the second position, and wherein the display is exposed from the casing more greatly when the movable member is positioned at the second position than when the movable member is positioned at the first position.

10. The terminal removable device according to claim 3, wherein the movable member includes a display configured to visibly display that the movable member is positioned at the second position, and wherein the display is exposed from the casing more greatly when the movable member is positioned at the second position than when the movable member is positioned at the first position.

11. The terminal removable device according to claim 2, wherein the casing has a first surface and a second surface facing each other, wherein the insertion port is formed on each of the first surface and the second surface, wherein a first protrusion of a first movable member which latches the terminal inserted from the insertion port on the first surface side is disposed on the second surface side with a latching member, wherein a second protrusion of a second movable member that latches the terminal inserted from the insertion port on the second surface side is disposed on the first surface side with a latching member, and wherein the first movable member and the second movable member are arranged such that a straight line connecting the first protrusion of the first movable member and the second protrusion of the second movable member is oblique to a straight line connecting the insertion port on the first surface side and the insertion port on the second surface side.

12. The terminal removable device according to claim 3, wherein the casing has a first surface and a second surface facing each other, wherein the insertion port is formed on each of the first surface and the second surface, wherein a first protrusion of a first movable member which latches the terminal inserted from the insertion port on the first surface side is disposed on the second surface side with a latching member, wherein a second protrusion of a second movable member that latches the terminal inserted from the insertion port on the second surface side is disposed on the first surface side with a latching member, and wherein the first movable member and the second movable member are arranged such that a straight line connecting the first protrusion of the first movable member and the second protrusion of the second movable member is oblique to a straight line connecting the insertion port on the first surface side and the insertion port on the second surface side.

13. The terminal removable device according to claim 4, wherein the casing has a first surface and a second surface facing each other, wherein the insertion port is formed on each of the first surface and the second surface, wherein a first protrusion of a first movable member which latches the terminal inserted from the insertion port on the first surface side is disposed on the second surface side with a latching member, wherein a second protrusion of a second movable member that latches the terminal inserted from the insertion port on the second surface side is disposed on the first surface side with a latching member, and wherein the first movable member and the second movable member are arranged such that a straight line connecting the first protrusion of the first movable member and the second protrusion of the second movable member is oblique to a straight line connecting the insertion port on the first surface side and the insertion port on the second surface side.

14. The terminal removable device according to claim 5, wherein the casing has a first surface and a second surface facing each other, wherein the insertion port is formed on each of the first surface and the second surface, wherein a first protrusion of a first movable member which latches the terminal inserted from the insertion port on the first surface side is disposed on the second surface side with a latching member, wherein a second protrusion of a second movable member that latches the terminal inserted from the insertion port on the second surface side is disposed on the first surface side with a latching member, and wherein the first movable member and the second movable member are arranged such that a straight line connecting the first protrusion of the first movable member and the second protrusion of the second movable member is oblique to a straight line connecting the insertion port on the first surface side and the insertion port on the second surface side.

15. The terminal removable device according to claim 5, further comprising:

an assist terminal configured to be connected to another electric device, wherein the assist terminal is electrically connected to the terminal inserted into the casing.

* * * * *